US005087349A

United States Patent [19]

Goelzer et al.

[11] Patent Number: 5,087,349

[45] Date of Patent: Feb. 11, 1992

[54] PROCESS FOR SELECTIVELY MAXIMIZING PRODUCT PRODUCTION IN FLUIDIZED CATALYTIC CRACKING OF HYDROCARBONS

[75] Inventors: Alan R. Goelzer, Atkinson, N.H.; Francis A. Demers, Topsfield, Mass.

[73] Assignee: Stone & Webster Engineering Corporation, Boston, Mass.

[21] Appl. No.: 602,416

[22] Filed: Oct. 22, 1990

Related U.S. Application Data

[63] Continuation of Ser. No. 273,267, Nov. 18, 1988, abandoned.

[51] Int. Cl.[5] ..... C10G 11/18

[52] U.S. Cl. ..... 208/113; 208/452; 208/155; 208/159

[58] Field of Search ..... 258/113, 482, 153, 155, 258/164, 159

[56] References Cited

U.S. PATENT DOCUMENTS

| | | | |
|---|---|---|---|
| 2,908,630 | 10/1959 | Friedman . | |
| 2,938,856 | 5/1960 | Hettick . | |
| 3,186,805 | 6/1965 | Gomory . | |
| 3,617,497 | 11/1971 | Bryson et al. . | |
| 3,761,391 | 9/1973 | Conner | 208/113 |
| 3,862,898 | 1/1975 | Boyd et al. . | |
| 3,886,060 | 5/1975 | Owen . | |
| 3,893,905 | 7/1975 | Fenske et al. . | |
| 3,894,932 | 7/1975 | Owen . | |
| 3,927,172 | 12/1975 | Davis, Jr. et al. . | |
| 3,928,173 | 12/1975 | James . | |
| 4,026,789 | 5/1977 | James . | |
| 4,143,086 | 3/1979 | Carle et al. . | |
| 4,146,465 | 3/1979 | Blazek, Sr. et al. . | |
| 4,218,306 | 8/1980 | Gross et al. . | |
| 4,234,411 | 11/1980 | Thompson . | |
| 4,295,961 | 10/1981 | Fahrig et al. | 288/153 |
| 4,331,533 | 5/1982 | Dean et al. . | |
| 4,332,674 | 6/1982 | Dean et al. | 208/120 |
| 4,336,160 | 6/1982 | Dean et al. . | |
| 4,422,925 | 12/1983 | Williams et al. . | |
| 4,434,049 | 2/1984 | Dean et al. . | |
| 4,435,279 | 3/1984 | Busch et al. . | |
| 4,534,851 | 8/1985 | Allan et al. . | |
| 4,556,479 | 12/1985 | Mauleon et al. . | |
| 4,601,814 | 7/1986 | Mauleon et al. . | |
| 4,624,771 | 11/1986 | Lane et al. | 208/74 |
| 4,664,778 | 5/1987 | Reinkemeyer . | |
| 4,764,268 | 8/1988 | Lane | 208/113 |
| 4,780,195 | 10/1988 | Miller . | |
| 4,786,400 | 11/1988 | Farnsworth | 208/80 |
| 4,818,372 | 4/1989 | Mauleon et al. | 208/113 |
| 4,822,761 | 4/1989 | Walters et al. | 208/113 |
| 4,904,372 | 2/1990 | Goelzer . | |

OTHER PUBLICATIONS

Mauleon, et al., "Characterization and Selection of Heavy Feeds for Upgrading through Fluid Catalytic Cracking Process", Twelfth World Petroleum Congress, Houston, Tex. (1987).

*Primary Examiner*—Anthony McFarlane
*Attorney, Agent, or Firm*—Hedman, Gibson & Costigan

[57] ABSTRACT

An improved process for controlling desired product distribution in fluidized catalytic cracking of olefins is provided wherein riser reactor temperature profiles are controlled by means of atomized quench streams provided downstream of the hydrocarbon feedstock charge level.

13 Claims, 2 Drawing Sheets

PROCESS FOR SELECTIVELY MAXIMIZING PRODUCT PRODUCTION IN FLUIDIZED CATALYTIC CRACKING OF HYDROCARBONS

This is a continuation of application Ser. No. 07/273,267, filed Nov. 18, 1988, now abandoned.

FIELD OF THE INVENTION

The present invention relates to processes used in catalytic cracking of gas oils and residual oils, and particularly to an improved process for maximizing light cycle oil/distillate and/or light olefin production in such processes. More particularly, the present invention provides a process for controlling riser reactor temperature profiles in such catalytic cracking operations thereby controlling the desired product distribution by means of atomized quench streams provided downstream of the feedstock and catalyst injection point.

BACKGROUND OF THE INVENTION

Fluidized catalytic cracking (FCC) processes have been used extensively in the conversion of high boiling portions of crude oils such as gas oil and heavier components customarily referred to as residual oils, reduced crude oils, atmospheric tower bottoms, topped crudes, vacuum resids and the like, to produce useful products such as gasoline, fuel oils, light olefins and other blending stocks. The processing of such heavy feedstocks which comprise very refractory components, e.g. polycyclic aromatics and asphaltenes, and which deposit large amounts of coke on the catalyst during cracking typically require severe operating conditions including high temperatures which in turn have presented problems of exceeding operating limits of plant materials of construction as well as catalyst impairment.

At present, there are several FCC processes available for catalytic conversion of such heavy hydrocarbon feedstocks. A particularly successful approach which significantly diminishes such problems as mentioned above is described, for example, in U.S. Pat. Nos. 4,664,778; 4,601,814, 4,336,160; 4,332,674 and 4,331,533. In such processes, a combination high temperature fluidized catalytic cracking-regeneration operation is provided for the simultaneous conversion of both of the high and low boiling components contained in gas oils and residual oils with high selectivity to gasoline and lighter components, and with low coke production. These high temperature conversion processes have been made possible in part due to the use of two-stage catalyst regeneration processes. In the first stage of such regeneration processes, catalyst particles, which have deposited on them hydrocarbonaceous materials such as coke, are regenerated under conditions of oxygen concentration and temperature selected to particularly burn hydrogen associated with hydrocarbonaceous material. These conditions result in a residual level of carbon left on the catalyst and the production of a carbon monoxide (CO)-rich flue gas. This relatively mild first regeneration serves to limit local catalyst hot spots in the presence of steam formed during hydrogen combustion so that formed steam will not substantially reduce the catalyst activity. A partially regenerated catalyst substantially free of hydrogen in the remaining coke and comprising residual carbon is thus recovered from the first regenerator and passed to a second stage higher temperature regenerator where the remaining carbon is substantially completely burned to $CO_2$ at an elevated temperature up to 1800° F.

This second stage regeneration is conducted under conditions and in the presence of sufficient oxygen to burn substantially all residual carbon deposits and to produce $CO_2$-rich flue gas.

The regenerated catalyst is withdrawn from the second stage and charged to the riser reactor at a desired elevated temperature and in an amount sufficient to result in substantially complete vaporization of the hydrocarbon feed. The catalyst particles are at a temperature typically above 1300° F. and often above 1400° F., such that at the selected catalyst feed rate and hydrocarbon feed rate the vaporizable components of the hydrocarbon feed are substantially completely vaporized rapidly in the riser reactor whereby subsequent catalytic cracking of the feed is accomplished.

As will be appreciated by those skilled in the art, the above-described processes make feasible the high temperature conversion processes required to convert gas oils and residual oils and other high boiling components of crude oils by substantially removing higher temperature restrictions and extending the temperature of regeneration up to 1800° F. if need be without exceeding the metallurgical limits of the regeneration equipment and unduly impairing catalyst activity.

As will also be appreciated by those persons skilled in the art, such FCC processes as described above have the potential capability for maximizing selected product yields, for example, gasoline or light cycle oils (LCO)/-distillate, from a given hydrocarbon feedstock. As an FCC unit operation is shifted from a gasoline producing mode, for example, into a maximum distillate producing mode or operation, the LCO yield and cetane quality thereof improves and thus can be used more favorably for blending to form a diesel fuel product. In another embodiment, such processes also have the potential capability of producing large yields of olefins, especially propylene and butylenes, for use as valuable alkylation gasoline charge stock, or in the manufacture of petrochemicals.

It is therefore often desirable to operate such FCC processes in such a manner so as to maximize the production of a given product or products. For example, any or all of the above operations may be relied upon for upgrading a heavy hydrocarbon feedstock, e.g. gas oil and/or residual oil or portions thereof, to produce maximum quantities of fuel oil distillates and diesel fuel at the expense of gasoline or, alternatively, to produce maximum quantities of olefins and other gasoline charge stocks, in order that adequate supplies of such desired products may be available during times of increased demand.

It is known that depending upon the riser reactor cracking severity selected, e.g. reactor outlet temperature (ROT) selected, a significant improvement in LCO/distillate product with a reduction in gaseous product yield can be achieved, or, alternatively, an improvement in light olefin products can be achieved. In particular, it is known that LCO distillate yields can be maximized by restricting a riser outlet cracking temperature to within the range of about 870° F. to about 950° F., and more particularly with the range of about 880° F. to about 970° F. Thus, LCO/distillate and other fuel products production is maximized as conversion of the hydrocarbon feedstock to gaseous product yield including $C_3/C_4$ olefins and lower boiling range material is decreased.

It is also known that yields of light olefins can be maximized by operating a riser outlet cracking temperature within the range of about 1000° F. to about 1100° F., and more particularly within the range of about 1020° F. to about 1060° F.

Conversion, which increases with temperature, is normally controlled in FCC processes by the amount of hot regenerated catalyst cycled through the riser reactor in a given amount of time, e.g. catalyst-to-oil ratio. However, decreasing the catalyst-to-oil ratio to restrict the riser cracking outlet temperature and thus the conversion to maximize LCO/distillate production, or to increase the production of light olefins is accompanied by several disadvantages. First, a lower catalyst-to-oil, ratio decreases the rate of catalytic activity. Moreover, in most cases, the riser outlet temperature is essentially determinant of the mix zone temperature, or the theoretical equilibrium temperature which would occur by combining a given ratio of hot regenerated catalyst and hydrocarbon feed thereby leading to vaporization of the feed before catalytic cracking begins. As the mix zone temperature decreases due to a lower riser outlet temperature (lower severity-lower conversion operation), a larger fraction of the hydrocarbon feed may not vaporize upon injection in the riser. This can cause the apparent oil and coke deposition on the catalyst to rise very quickly. Such increased coke deposition is considered to be unnecessary and tends block catalyst cracking sites. Raising the riser temperature to increase the mix temperature is undesirable when, for example, attempting to maximize LCO/distillate production since this promotes undue cracking reactions resulting in a high production of gasoline, and thus the desired selectivity to distillate fuels is lost.

Further, when operating a catalytic cracking operation in a high conversion mode at high riser reactor outlet temperature, for example, to maximize production of $C_3$ through $C_6$ light olefinic materials, excessive coking can occur due to polymerization and/or recracking of already heavily reacted light cycle oil and heavy cycle/slurry oil conversion products, and in the production of unwanted diolefins from thermal overcracking, thus detracting from the desired product yield.

In view of the above, it is therefore an object of the present invention to provide an improved version of a combination high temperature fluidized catalytic cracking-regeneration process wherein the production of a desired product or products from catalytic cracking of gas oils or residual oils or mixtures thereof and the like is maximized. More particularly, it is an object of this invention to provide such processes which produce more fuel oil distillates and diesel oil or alternatively more light olefins and gasoline charge stocks than is conventional while avoiding problems associated with restricting riser reactor outlet temperatures or alternatively, those problems which can arise when operating a riser reactor in a catalytic cracking operation at high outlet temperatures such as mentioned above.

It is a further object of the present invention to provide such processes as described above wherein catalyst regeneration is carried out successively in separate, relatively lower and higher temperature, regeneration zones each independently operating under selected conditions.

Additional objects of the present invention will become apparent from the following summary and detailed discussion of preferred embodiments of this invention.

SUMMARY OF THE INVENTION

In accordance with the present invention, an improved high temperature fluidized catalytic cracking-regeneration process is provided wherein the desired product production to maximum distillate or to light olefins is maximized by selectively restricting the respective riser catalytic cracking temperatures to optimal ranges by controlling the riser reactor temperature profile to achieve a desired rate of conversion of the feedstock within the reaction zone. To this end, it has now been found that the desired cracking severity, e.g. riser catalytic cracking temperature, for selected product production can be achieved independently of the desired mix zone temperature and without interfering with high conversion when desired by recycling a light hydrocarbon stream, for instance a naphtha product stream or a lower boiling material, as an atomizing quench stream downstream of the fresh feed injection zone commonly known as the mix zone.

Thus, the desired catalytic cracking reactions can be accomplished by separately adjusting cracking conditions, e.g. optimal reaction temperature profile, optimal regeneration temperature and catalyst-to-oil ratio, and the like depending upon the desired maximized product production contemplated, wherein the mix zone temperature and riser outlet temperature are separately maintained.

The present invention thus provides an improved fluidized catalytic cracking-regeneration process for cracking hydrocarbon feedstocks or the vapors thereof with a cracking catalyst. Accordingly, the process of the present invention comprises catalytic cracking of hydrocarbon feedstocks in a riser conversion zone to produce hydrocarbon conversion products comprising a heavy FCC naphtha fraction and materials lower boiling than said heavy naphtha fraction; a light cycle oil/distillate fraction; a heavy cycle oil fraction and materials higher boiling than said heavy cycle oil fraction; then separating catalyst particles comprising hydrocarbonaceous deposits thereon from the hydrocarbon conversion products, and regenerating the separated catalyst particles in at least one catalyst regeneration zone in the presence of a source of oxygen; and recycling the regenerated catalyst back to the riser conversion zone, wherein the improvement of the present invention comprises the steps:

(a) charging a hydrocarbon feedstock into a riser conversion zone wherein said hydrocarbon feedstock is admixed with freshly regenerated cracking catalyst as a suspension at an elevated temperature and under conditions to maintain a mix zone temperature within the range of about 960° F. to about 1160° F., and thereafter passing the suspension upwardly through a lower portion of the riser conversion zone;

(b) charging a recycled portion of a light liquid hydrocarbon stream selected from heavy FCC naphtha or a lower boiling material or a combination thereof produced from hydrocarbon conversion into said upwardly flowing suspension in the riser zone at a level from 3 to about 9 feet above the hydrocarbon feedstock charge level and under conditions and at a temperature sufficient to maintain a riser conversion zone outlet temperature within the range of about 870° F. to about 950° F.; then (c) recovering an improved yield of light cycle oil/-distillate product over that obtainable at the same mix zone outlet temperature in the absence of charging the light liquid hydrocarbon stream.

The present invention further provides an improved process such as described above wherein the light liquid hydrocarbon stream is charged at a level from 20 to about 40 feet above the riser fresh feed inlet and under conditions and at a temperature sufficient to maintain a riser conversion zone outlet temperature within the range of about 870° F. to about 1020° F., and then recovering an improved yield of light olefin product over that obtainable at the same outlet temperature in the absence of charging the recycled heavy FCC naphtha.

The process of the present invention will be better understood by reference to the following detailed discussion of preferred embodiments and the attached FIGURES which illustrate and exemplify such embodiments. It is to be understood, however, that such illustrated embodiments are not intended to restrict the present invention since many more modifications may be made within the scope of the claims without departing from the spirit thereof.

DETAILED DISCUSSION OF PREFERRED EMBODIMENTS OF THE INVENTION

Figure 1:
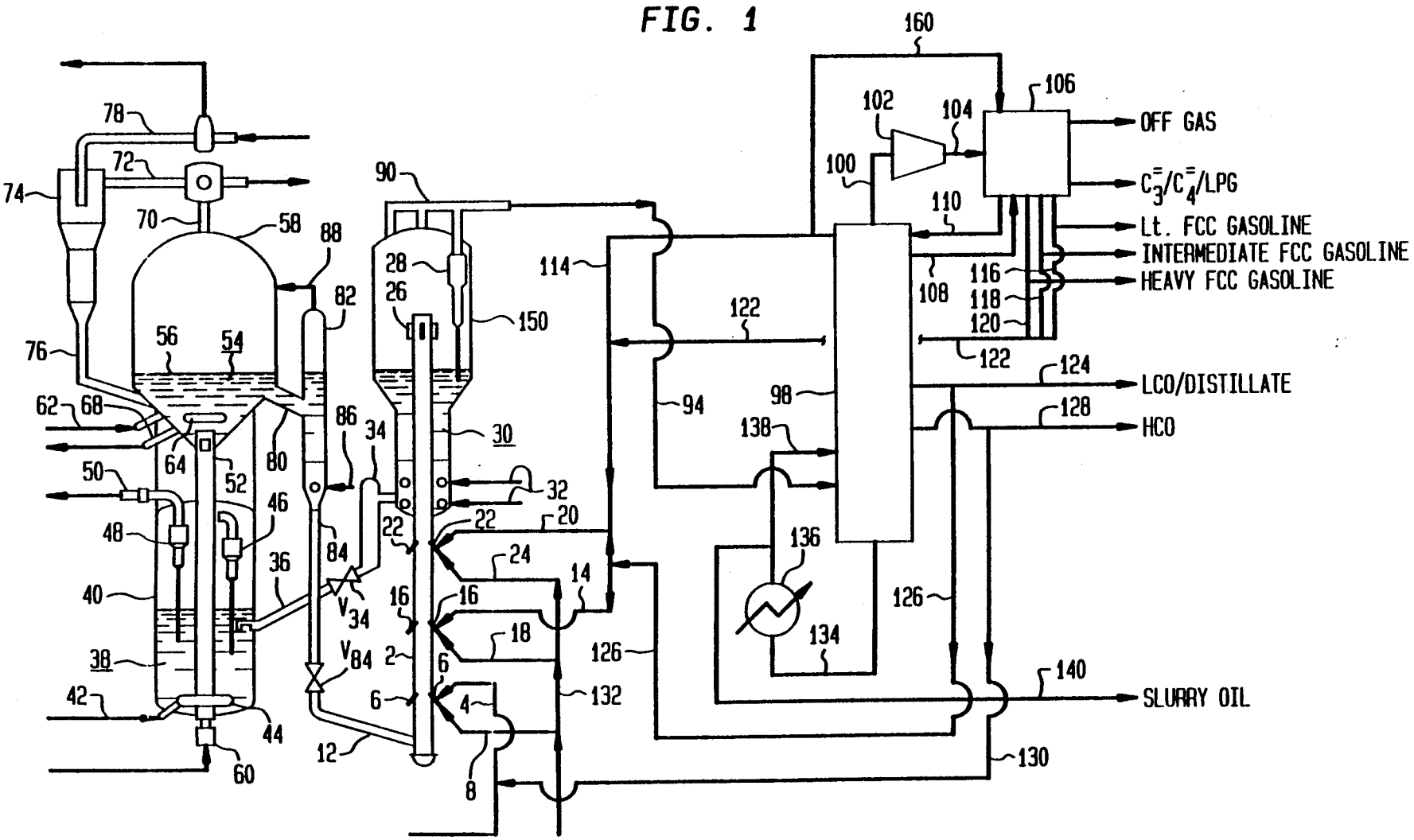
FIG. 1 is an elevational schematic of the process and apparatus of the present invention shown in a combination fluidized catalytic cracking-regeneration operation, wherein a riser reactor is fitted with three injection ports for hydrocarbon feed. The bottom most port is for fresh uncracked hydrocarbon feed and the upper two ports are for introduction of quench feed streams, and wherein regeneration is conducted in two separate, relatively higher and lower temperature, zones.

The catalytic cracking process of this invention relates to the fluidized catalytic cracking of hydrocarbon feedstocks, preferably economically obtained heavy hydrocarbon feedstocks generally referred to as gas oils, vacuum gas oils comprising residual components, residual oils, reduced crude, topped crude, and mixtures of gas oil with high boiling residual hydrocarbons comprising metallo-organic compounds and the like. These are among several terms used in the art to describe portions of crude oil such as a gas oil with or without a higher boiling hydrocarbon feed portion which may comprise metallo-organic compounds, and essentially all other heavy hydrocarbon feedstocks having a Conradson Carbon residue of at least 2 weight percent and boiling initially at least 400° F., with approximately 20 weight percent or more of the components therein boiling at about 1000° F. or above.

Products obtained from cracking such feedstocks include, but are not limited to, gaseous product streams comprising $C_3$ through $C_6$ light olefins, $C_5$–$C_6$ light FCC gasoline, intermediate FCC gasoline comprising benzene and $C_8$–$C_9$ hydrocarbons, heavy FCC gasoline comprising $C_9$–$C_{11}$ hydrocarbons and other gasoline boiling range products comprising materials boiling in the range $C_5$ to about 430° F., light cycle oil/distillate boiling in the range from about 430° to about 630° F., a heavy cycle oil product boiling from about 630° F. to about 900° F., and a slurry oil boiling from about 670° F. to about 970° F. and above. Additionally, a heavy cracked naphtha is produced and drawn down as the front end of the light cycle oil/distillate fraction or produced separately and which boils typically in the range from about 330° F. to about 430° F., and more typically from about 350° F. to about 415° F.

The process of this invention also relates to the recracking of heavy FCC naphthas such as described above, to produce, among other things, increased production of light olefins for alkylation reactions to produce high octane blending stock or for petrochemical manufacture. In accordance with this invention, fresh heavy hydrocarbon feedstocks, typically comprising a mixture of vacuum gas and residual oils, is introduced into an elongated riser reactor preferably by injection thereof at the bottom portion of the riser using atomizing spray nozzles or some other known high energy injection system sufficient to effect a rapid and substantially complete vaporization of the feed to occur upon contact with upwardly flowing highly active freshly regenerated cracking catalyst. Thus, hydrocarbon feed is mixed with the hot regenerated catalyst at such a temperature and under conditions to form a highly vaporized contact phase of the hydrocarbon feed with dispersed high temperature fluid catalyst particles at a temperature ranging from about 960° F. to about 1160° F., referred to herein as the mix zone outlet temperature. For purposes of this invention the mix zone temperature can be defined as the theoretical temperature that occurs between hot regenerated catalyst particles at a given catalyst-to-oil ratio and vaporized hydrocarbon feed wherein substantially no hydrocarbon liquids remain, but catalytic cracking has not yet substantially begun. More particularly, a suspension is thus formed in a riser conversion zone at selected conditions of temperature, catalyst-to-oil ratio, and contact time so as to maximize substantially instantaneous vaporization of vaporizable hydrocarbon feed upon injection in the riser and to minimize thermal conversion of the hydrocarbon feed. The hydrocarbon feed can be contacted with the fluid cracking catalyst particles at an elevated temperature in the presence of one or more diluent materials such as water or steam in the riser contact zone. Such diluent materials can also be introduced into the riser by injection through atomizing spray nozzles and the like.

The contact of the atomized hydrocarbon feed with the hot fluid catalyst particles effects a substantially complete vaporization of the hydrocarbon feed under such mix zone temperatures and conditions within about 0.25 seconds or less, or from about 3 to about 9 feet up the riser reactor. To maximize light cycle oil/-distillate production in one embodiment of this invention, immediately after substantially complete vaporization of the feed has taken place in the mix zone and prior to any substantial catalytic conversion of the hydrocarbon feed in the next zone referred to herein as the primary catalytic zone, the substantially completely vaporized hydrocarbon-catalyst feed mixture is quenched to a temperature ranging from 870° F. to about 950° F. and preferably from 880° F. to 910° F., by means of a light volatile liquid hydrocarbon injected downstream of the fresh hydrocarbon feed riser injection point. The light volatile liquid hydrocarbon is injected into the riser reactor using atomizing spray nozzles and the like to quench the heavy hydrocarbon-catalyst mixture and to lower the riser temperature in the primary catalytic zone to desired levels while maintaining a sufficiently high temperature in the mix zone. The effect is to enhance desirable vaporization and thermal cracking of higher boiling components in the hydrocarbon feed prior to catalytic cracking of the ligher components in the primary riser reactor zone. The riser outlet temperature must still be high enough to effect conversion of the higher boiling point components of the hydrocarbon feed into the desired products, e.g. light cycle oil/-distillate.

The subsequent heating and vaporization of the light hydrocarbon quench stream after injection reduces the aggregate mixture temperature in the riser reactor by approximately 20° F. to 100° F. As will be appreciated by those skilled in the art, the lower temperature of hydrocarbon-catalyst mixture leaving the mix zone and entering the primary catalytic zone has the effect of reducing the rate of catalytic conversion of the hydrocarbon feed into gasoline and $C_3$–$C_6$ olefinic products thereby enhancing the production of light cycle oil/distillate, and to a lesser extent materials heavier boiling than light cycle oil.

A number of hydrocarbon streams may be employed for purposes of quenching in accordance with this invention. Preferably recycled FCC naphtha and materials lower boiling than FCC naphtha, comprising recycled light, intermediate and heavy recycled FCC gasolines are employed. Light cycle oil (LCO)/distillate alone or in combination with lighter materials described above is also contemplated as a quench hydrocarbon stream in the process of this invention. However, use of materials higher boiling than light cycle oil/distillate, e.g. heavy cycle oil, slurry oils, vacuum gas oils, resids and the like, is not encouraged due to the high presence of highly refractory coke producing components contained therein.

In another embodiment of the present invention, a process is provided for maximizing $C_3$ through $C_6$ light olefin production at high levels of hydrocarbon feed conversion through light hydrocarbon recycle quenching/temperature profiling similar to that described above. In general, conversion of hydrocarbon feeds to products such as $C_3$ through $C_6$ light olefinic materials increases with temperature and catalyst-to-oil ratio. However, as mentioned above, such operation of a catalytic cracking operation a high conversion mode at high riser reactor outlet temperatures can be accompanied by excessive cooking due to polymerization and/or recracking of already heavily reacted light cycle oils and heavy cycle oil/slurry oil conversion products, and the production of unwanted diolefins from thermal overcracking, thus detracting from the desired product yield. It has now been found, however, in accordance with the process of the present invention that such undesirable side reactions as described above can be significantly reduced by conveniently restricting the riser reactor outlet temperature in the secondary reaction zone of conversion to light $C_3$–$C_6$ olefinic products to temperatures of about 870° F. to about 1020° F. by means of quenching with an atomized light liquid hydrocarbon stream injected downstream of the mix zone and primary reaction zone described hereinabove. Such quenching is accomplished as described above by a volatile liquid hydrocarbon injected into the riser reactor at approximately 20 to about 40 feet downstream of the mix zone.

Such atomized light liquid hydrocarbon quenching thus roughly separates the riser reactor into three reaction zones: (1) a mix zone characterized by high temperatures ranging from 960° F. to about 1160° F. with a catalyst-hydrocarbon contact time of approximately 0.25 seconds (approximately 3 to 9 feet up the reactor riser); (2) a primary reaction zone characterized by somewhat lower temperatures ranging from 870° F. to about 1100° F. and a contact time of approximately 0.5 to 1 seconds (approximately 20 to 40 feet up the reactor riser), wherein substantially all of the light olefinic material is produced; and (3) a secondary reaction zone produced after quenching of the primary reaction zone elapsed contact time characterized by temperatures ranging from 870° F. to about 1020° F. As indicated above, increased production of LCO/distillate occurs on the lower side of these temperature ranges, and increased production of light olefinic material occurs at the higher side of these ranges. As will be appreciated by those persons skilled in the art, the mix zone temperature in operating the process of the present invention in a high conversion, maximum light olefinic production mode is generally in a favorable range, thereby eliminating the need to quench the mix zone outlet temperature in the manner described above for maximum LCO/distillate mode production, and thus is halted.

In accordance with the process of the present invention, therefore, the atomizing quench injection of light volatile liquid hydrocarbons can thus be employed to conduct riser reactor profiling for desired product production, for example, in the production of maximum yields of light cycle oil/distillate by maintaining desired lower riser reactor outlet temperatures while maintaining conditions in the fresh feed injection and mix zone at sufficiently high temperatures. Riser reactor profiling can also be conducted as in the manner described herein to maintain desired mix zone and primary catalytic zone temperatures while restricting secondary catalytic zone temperatures in production of maximum yields of light $C_3$ to $C_6$ olefinic materials.

In the process of the present invention, a suspension separation device, for example, an inertial separator, or disengaging vessel arrangement containing separator cyclones is provided at the riser reactor discharge for receiving the vaporized hydrocarbon-catalyst feed mixture including cracked products of convesion and separating entrained catalyst from vaporous hydrocarbon feed material and conversion products. The vaporous hydrocarbon products leaving the separator cyclones are then separated in a downstream main fractionation column to products more fully discussed hereinbelow. The spent catalyst particles comprising hydrocarbonaceous deposits recovered from the riser reactor in the cracking operation are thereafter stripped of entrained hydrocarbon material via treatment with steam or some other suitable stripping gas, then regenerated in at least one catalyst regeneration zone in the presence of a source of oxygen, and then recycled to the riser reactor conversion zone for additional cracking operation.

As will be appreciated and understood by those skilled in the art, the practice of the present invention may be effected in one stage regeneration or in a number of alternatively configured two stage units. It is preferred in the process of the present invention, however, to regenerate the spent catalyst particles by passing said particles, successively, to first and second (relatively lower and higher temperature) catalyst regeneration zones in the manner of the process described, for example, in U.S. Pat. Nos. 4,664,778; 4,601,814; 4,336,160; 4,332,674; and 4,331,533 which are incorporated herein by reference.

In such processes, the stripped spent catalyst is passed to a first dense fluid bed of catalyst in a first catalyst regeneration zone maintained under oxygen and temperature restricted conditions below about 1500° F., and preferably not above about 1300° F. Combustion of hydrocarbonaceous material or coke deposited on the spent catalyst in the first regeneration zone is conducted at relatively mild temperatures sufficient to burn substantially all the hydrogen present in the coke deposits and a portion of the carbon. The regeneration temperature is thus most preferably restricted to within the range of from 1100° F. to 1260° F. and preferably to a temperature which does not exceed the hydrothermal stability of the catalyst or the metallurgical limits of a conventional low temperature regeneration operation. Flue gases relatively rich in carbon monoxide are recovered from the first regeneration zone and can be passed, for example, to a carbon monoxide boiler or incinerator to generate steam by promoting a more complete combustion of available carbon monoxide therein, prior to combination with other process flue gas streams and passage thereof through a power recovery prime mover section to generate, for example, process compressed air in the manner set forth in commonly assigned copending U.S. patent application Ser. No. 07/273,266, filed Nov. 18, 1988 which is incorporated herein by reference.

A partially regenerated catalyst of limited temperature and comprising carbon residue is recovered from the first regeneration zone substantially free of hydrogen, and is passed to a second separate unrestrained higher temperature catalyst regeneration zone wherein the remaining coke deposits are substantially completely burned to carbon dioxide at an elevated catalyst temperature within the range of 1300° F. up to 1800° F. and preferably within the range of 1330° F. to 1600° F., in a moisture free environment.

The second regeneration zone is designed to limit catalyst inventory and catalyst residence time therein at the high temperatures while promoting a carbon burning rate to achieve a residual carbon on recycled hot catalyst particles less than about 0.1 weight percent, preferably less than about 0.05 weight percent and more preferably less than about 0.03 weight percent.

Hot flue gases recovered from the second regeneration zone are fed to external cyclones for recovery of entrained catalyst fines before further utilization, for example, in combining with the prior combusted first regeneration zone flue gas in the manner set forth above.

The hot fully regenerated catalyst particles are then passed through a catalyst collecting zone and thereafter through conduits to the riser reactor for further cracking operation.

The subject apparatus to carry out the process of this invention is thus a combination catalytic-regeneration operation comprising an elongated riser reactor for catalytically cracking hydrocarbon feeds under operating parameters permitting selective conversion to desired products. The riser reactor is fitted with a bottom port for receiving hot freshly regenerated catalyst and at least two, preferably three, inlet or injection ports for receiving hydrocarbon feed streams which include a injector point on the bottom portion of the riser reactor for fresh uncracked hydrocarbon feed, an injector point at a distance of from about 3 to about 9 feet up the riser reactor from the fresh feed injection point for introducing a recycled light hydrocarbon liquid stream as a quench when running the cracking-regeneration operation of the present invention in a maximum light cycle oil/distillate production mode, and/or an injector point at a distance of from about 20 to about 40 feet up the riser reactor from the fresh feed injection point also for introducing a recycled light hydrocarbon liquid stream as a quench when running the cracking-regeneration operation of the present invention in a maximum light olefin production mode.

It is also contemplated in the present invention to operate three injection inlets simultaneously wherein fresh uncracked hydrocarbon feed is introduced through a bottommost injector port and recycled light liquid hydrocarbon quench is simultaneously injected through at least two other injection points situated at points in the riser as described hereinabove to optimize operations, for example, in producing a maximum amount of gasoline boiling range material having higher research octane numbers.

The apparatus additionally comprises at least one catalyst regeneration zone for receiving spent catalyst particles and regenerating said particles by combusting hydrocarbonaceous material deposited thereon in the presence of an oxygen-containing gas. Preferably, the apparatus comprises separate first and second (relatively lower and higher temperature) catalyst-regeneration zones operated under conditions such as described hereinabove for supplying hot freshly regenerated catalyst to the riser reactor for continued cracking operation.

A fractional distillation zone is also provided for receiving the vaporous hydrocarbon effluent stream which includes cracked products of hydrocarbon conversion from a disengaging or separation device situated at the riser reactor discharge and for separating products therein, and from which light hydrocarbon streams such as FCC gasoline and FCC naphtha can be recycled to the riser reactor as quench streams.

Referring now to FIG. 1, there is shown an apparatus adapted for performing a preferred embodiment of the process of the present invention. Fresh hydrocarbon feed to be catalytically cracked typically comprising a mixture of gas oil and residual oil is introduced to a lower portion of a riser reactor 2 by conduit means 4 through a multiplicity of streams in the riser cross section charged through a plurality of horizontally spaced apart feed injection nozzles indicated by injection nozzle 6, which are preferably atomizing feed injection nozzles of the type described, for example in U.S. Pat. No. 4,434,049 which is incorporated herein by reference, or some other suitable high energy injection source preferably capable of producing globules of an average size of 500 microns or less in diameter and most preferably 100 microns or less in diameter. Steam or fuel gas may be introduced in the feed injection nozzles to facilitate atomization of the hydrocarbon feed through conduit means 8. Hot regenerated catalyst at a temperature ranging from about 1330° F. to about 1600° F. is introduced to the riser lower portion by transfer conduit means 12 and caused to flow upwardly and become commingled with the multiplicity of hydrocarbon feed streams in the riser reactor 2 cross section, thus maximizing catalyst-hydrocarbon feed contact, and in an amount sufficient to form a high temperature vaporized mix with the hydrocarbon feed ranging from about 960°

F. to about 1160° F., and a catalyst-to-oil ratio of from 5 to about 8, wherein substantially no liquid hydrocarbons remain after about 0.25 seconds or less.

When running the process of the present invention in a maximum LCO/distillate production mode, immediately after the atomized hydrocarbon feed has contacted the hot regenerated catalyst and become substantially completely vaporized (a time span equal to about 0.25 seconds or less as set forth above), a light hydrocarbon liquid quench stream, preferably recycled FCC naphtha or FCC gasoline or a mixture of both, is introduced into riser 2 approximately 3 to about 9 feet above the fresh feed injection point by conduit means 14 through a multiplicity of streams in the riser cross section charged through a plurality of horizontally spaced apart injection nozzles, indicated by injection nozzle 16. Such injection nozzles are preferably atomizing feed injection nozzles such as described above. The quench FCC naphtha or gasoline is introduced via an appropriate feed injection system and under conditions sufficient to reduce the mix zone outlet temperature discussed above by about 20° F. to about 100° F. in 0.25 second or less. The quench stream thus roughly separates the riser reactor 2 into three reaction zones: an upstream zone, referred to herein as the mix zone, characterized by high mix temperatures of the vaporized hydrocarbon-catalyst suspension, a relatively high catalyst-to-oil ratio, and short contact time; a midstream zone referred to herein as the primary catalytic zone operating under cracking conditions that are well known to produce products comprising primarily light cycle oil distillate including light olefins, cracked gasoline and heavier cracked oils; and a secondary catalytic cracking zone characterized as the upper portion of the riser reactor wherein the net temperature change is limited, typically less than 5° F. This secondary catalytic zone can form naturally or can be introduced as a result of a secondary light liquid hydrocarbon quench stream discussed more fully hereinbelow.

Steam or fuel gas may be introduced in the quench feed nozzles as described above through conduit means 18 to facilitate atomization of the light hydrocarbon liquid quench stream such that the mix zone outlet temperature is lowered to desired levels in sufficient time prior to the occurrence of extensive catalytic cracking of the hydrocarbon feed, thus to reduce hydrocarbon feed conversion to gasoline and lighter hydrocarbons and to maximize LCO/distillate production.

In an alternative embodiment to that described above, when running the process of the present invention in an increased $C_3$ through $C_6$ light olefinic material production mode, conditions in riser 2 are maintained under appropriate conditions known in the art to provide high conversion levels of heavy hydrocarbon feeds to the desired products. Generally, such conditions include maintaining a vaporized hydrocarbon-catalyst suspension in the mix zone at temperatures ranging from about 960° F. to about 1160° F., a catalyst-to-oil ratio of from 5 to about 9 and hydrocarbon feed mix zone contact times ranging from about 0.10 to about 0.25 seconds. Riser reactor operating conditions, wherein the desired cracking reactions associated with high conversion take place are maintained at primary catalytic zone outlet temperatures of about 1020° F. to about 1100° F., catalyst-to-oil ratios of about 5 to about 9, and catalyst-hydrocarbon feed contact times of about 0.5 to about 1.0 seconds.

In accordance with the present invention, conditions determined to be optimal for producing maximum yields of $C_3$ through $C_6$ olefinic materials, especially $C_3/C_4$ olefinic materials, can be tightly controlled by the introduction of a light hydrocarbon liquid quench steam as herein provided to immediately reduce the temperatures in the primary catalytic zone to a range of from about 870° F. to about 1020° F. after the desired contact time at higher temperatures has elapsed to reduce conversion and substantially reduce the production of unwanted materials such as polymer light coke and gaseous diolefinic materials which can detract from maximum yields of $C_3$ through $C_6$ light olefinic materials. Thus, a light liquid hydrocarbon quench stream, preferably of a composition as described above, is introduced into riser reactor 2 at a point from about 20 to 40 feet above the fresh feed injection point on the riser reactor 2 by conduit means 20 through a multiplicity of streams in the riser cross section charged through a plurality of horizontally spaced apart injection nozzles indicated by injection nozzle port 22. Said injection nozzles are preferably atomizing feed nozzles such as described hereinabove. The quench FCC naphtha or gasoline is introduced via an appropriate feed injection system and under conditions sufficient to reduce the primary catalytic zone temperatures by 20° F. to about 80° F. in about 0.2 seconds or less. Therefore, as set forth hereinabove, in operating the present invention in an increased $C_3$ through $C_6$ light olefin production mode, the quench stream roughly separates the riser reactor 2 into three reaction zones: an upstream zone or mix zone characterized by high mix temperatures of the thus vaporized hydrocarbon-catalyst suspension, a relatively high catalyst-to-oil ratio and short contact time; a midstream primary catalytic zone operating under cracking conditions well known in the art to produce products comprising $C_3$ through $C_6$ light olefinic material from high conversion of hydrocarbon feeds inclusive of higher and lower boiling cracked products; and subsequent to quenching and lowering of the primary catalytic zone outlet temperature, a secondary catalytic zone characterized by relatively low riser outlet temperatures.

Steam or fuel gas may also be introduced into the quench feed injection nozzles as in the manner described above through conduit means 24 to facilitate the atomization of the light liquid hydrocarbon quench such that the desired delta temperature from the primary catalytic zone can be described within the desired time of less than about 0.2 seconds.

The process of the present invention also contemplates operating quench injection nozzles 6 and 22 simultaneously with the introduction of hydrocarbon feed and hot regenerated catalyst to provide flexibility in the optimization of other desired maximum product production. For example, volumetric yields of gasoline boiling range material having desirably high research octane numbers and aromaticity may be maximized by optimizing riser reactor operating temperatures and conditions through simultaneous light hydrocarbon quenching as herein provided.

Notwithstanding the operational mode of the present invention, e.g. whether lower or higher or both light hydrocarbon quench injection nozzles are employed, riser reactor effluent comprising a mixture of vaporized hydrocarbon and suspended catalyst particles including cracked products of conversion pass from the upper end of riser 2 through discharge through an initial rough separation in a suspension separator means, indicated by 26, such as an inertial separator, and/or passed to one or more cyclone separators 28 located in the upper portion of vessel 150 for additional separation of volatile hydrocarbons from catalyst particles.

Catalyst separated by means 26 and cyclones 28 is collected as a bed of catalyst 30 in a lower portion of vessel 150. Stripping gas, such as steam, is introduced to the lower bottom portion of the bed by conduits 32. Stripped catalyst is passed by from vessel 150 into catalyst holding vessel 34, through valve $V_{34}$ and conduit 36 to a bed of catalyst 38 being regenerated in vessel 40, the first regeneration zone. Regeneration gas, such as air, is introduced to a bottom portion of bed 38 by conduit means 42 communicating with air distributor ring 44. Regeneration zone 40 is maintained as a relatively low temperature regeneration operation below 1500° F., preferably below 1300° F., and under conditions selected to achieve at least a partial removal of carbon deposits and substantially all of the hydrogen associated with deposited hydrocarbonaceous material of cracking. In this first regeneration operation a flue gas relatively rich in CO is formed which is separated from entrained catalyst fines by one or more cyclones, such as cyclones 46 and 48, in parallel or sequential arrangement with another cyclone. CO-rich flue gases recovered from the cyclone separating means in the first regeneration zone by conduit 50 can be directed, for example, to a carbon monoxide boiler or incinerator and/or a flue gas cooler (not shown) to generate steam by a more complete combustion of available carbon monoxide therein prior to combination with other process flue gas streams and passage through a power recovery prime mover section to operate process compressed air in the manner described hereinabove.

Partially regenerated catalyst is withdrawn from a lower portion of bed 38 for transfer upwardly through riser 52 to discharge into the lower portion of a dense fluid bed of catalyst 54 having an upper interface 56 in an upper separate second zone of catalyst regeneration in vessel 58. Lift gas, such as compressed air, is charged to the bottom inlet of riser 52 by a hollow stem plug valve 60 comprising flow control means (not shown). Regeneration gas, such as air or oxygen enriched gas, is charged to bed 54 by conduit means 62 communicating with an air distributor ring 64. As shown in FIG. 1, vessel 58 in the second regeneration zone is substantially free of exposed metal internals and separating cyclones such that the high temperature regeneration desired may be effected without posing temperature problems associated with materials of construction. Thus temperature conditions may be unrestrained and allowed to exceed 1500° F. and reach as high as 1800° F. or as required to complete carbon combustion. However, temperatures are typically maintained between 1330° F. and 1600° F. In this catalyst regeneration environment, residual carbon deposits remaining on the catalyst following the first temperature restrained regeneration zone are substantially completely removed in the second unrestrained temperature regeneration zone. The temperature in vessel 58 in the second regeneration zone is thus not particularly restricted to an upper level except as possibly limited by the amount of carbon to be removed and heat balance restrictions of the catalytic cracking-regeneration operation. In accordance with the process and apparatus of the present invention, the second regeneration zone 58 is preferably provided with a means (not shown) connected therewith by conduit 68 for removing heat from the regenerator, therein enabling a lower regenerator temperature as desirable. Heat removal means which are preferred herein include a controllable catalyst cooler such as disclosed, for example, in U.S. Pat. Nos. 2,970,117 and 4,064,039. In such preferred means, a portion of the catalyst in a regenerator is withdrawn from a lower port thereof, passed downwardly out of the regenerator, lifted, for example, with air as a fluidized bed through an indirect water cooler steam generator, then lifted into an upper port of the regenerator. If desired, the cooled catalyst can alternatively be reintroduced into a lower port of the regenerator. Depending upon the coke forming tendencies of the heavy hydrocarbon feeds to be processed, e.g. the Conradson Carbon residue values of the feedstocks, the cooler will be sized accordingly.

Sufficient oxygen is charged to vessel 58 to produce a relatively $CO_2$-rich flue gas with traces of CO, and in amounts supporting combustion of the residual carbon on the catalyst. The $CO_2$-rich flue gas thus generated passes with some entrained catalyst particles from the dense fluid catalyst bed 54 into a more dispersed catalyst phase thereabove from which the flue gas is withdrawn by conduits 70 and 72 communicating with one or more cyclone separators indicated by 74. Catalyst particles thus separated from the hot flue gases in the cyclones are passed by dipleg means 76 to the bed of catalyst 54 in the second regeneration zone 58. $CO_2$-rich flue gases absent combustion supporting amounts of CO are recovered by conduit 78 from cyclone 74 for use as herein described. Catalyst particles regenerated in zone 58 at a high temperature up to 1800° F. are withdrawn by refractory lined conduit 80 for passage to collection vessel 82 and thence by conduit 84 through flow control valve $V_{84}$ to conduit 12 communicating with the riser reactor 2 as above discussed. Aerating gas is introduced into a lower portion of vessel 82 by conduit means 86 communicating with a distributor ring within the vessel 82. Gaseous material withdrawn from the top portion of vessel 82 by conduit means 88 passes into the upper dispersed catalyst phase of vessel 58.

Separated vaporous hydrocarbons are withdrawn along with materials from hydrocarbon cracking in riser reactor 2 through conduit means 90 and transfer conduit means to the lower portion of a main fractional distillation column 98 wherein product vapor is fractionated into a plurality of desired component fractions. From the top portion of main fractional distillation column 98, a gas fraction is withdrawn via conduit means 100 for passage to a "wet gas" compressor 102 and subsequently through conduit 104 to a gas separation plant 106. A light liquid fraction comprising FCC naphtha and lighter $C_3$–$C_6$ olefinic material is also withdrawn from a top portion of the main fractional distillation column 98 via conduit means 108 for passage to gas separation plant 106. Products produced in the gas separation plant 106 comprise a $C_3/C_4$ light olefin LPG fraction which is passed for further processing for example to propylene in processing means not shown including an off gas comprising lighter boiling material; a light FCC gasoline product boiling up to about 180° F.; an intermediate FCC gasoline product boiling in the range from 100° F. to about 310° F.; and a heavy FCC gasoline boiling in the range from 310° F. to about 430° F.

A pump around conduit means 114 in communication with the upper portion of main fractional distillation column 98 is provided for supplying a portion of the heavy FCC naphtha stream or product produced herein to conduit means 20 and/or 14 as a light liquid hydrocarbon quench stream in the manner herein provided. The process and apparatus of the present invention also contemplates providing materials lower boiling than heavy FCC naphtha as a quench stream, for example, light, intermediate and heavy FCC gasoline as represented in FIGURE I, via conduit means 116, 118 and 120, respectively, supplied by conduit means 122 in communication with conduit means 114. A portion of the heavy FCC naphtha stream can also be passed through conduit means 160 as a lean oil material to gas separation plant 106.

A light cycle gas oil (LCO)/distillate fraction containing naphtha boiling range hydrocarbons is withdrawn from said main fractional distillation column 98 through conduit means 124, said LCO/distillate fraction having an initial boiling point in the range of about 300° F. to about 430° F., and an end point of about 600° F. to 670° F. The LCO/distillate fraction can be further processed in a stripper vessel (not shown) within which said LCO/distillate fraction is contacted with stripping vapors thereby stripping the lighter naphtha components from said fraction, producing a stripped LCO/distillate stream which can thereafter be passed to a hydrotreater or other appropriate processing for conversion into diesel blending stock. Stripped vapors therefrom comprising naphtha boiling range material can be passed by means (not shown) from said stripper vessel back to the main product fractionator.

It is also contemplated in the process and apparatus of the present invention to pass a portion of the thus produced LCO/distillate via conduit means 126 to conduit 114 to be used in conjunction with other light liquid hydrocarbon quench streams described herein to optimize desired product production.

A non-distillate heavy cycle gas oil (HCO) fraction having an initial boiling range of about 600° F. to about 670° F. is withdrawn from the main fractional distillation column 98 at an intermediate point thereof, lower than said LCO/distillate fraction draw point via conduit means 128. At least a portion of the HCO stream can be passed via conduit means 130 to conduit 4 for recracking in riser reactor 2 in the manner herein provided.

From the bottom portion of said main fractional distillation column 98, a slurry oil containing non-distillate HCO boiling material is withdrawn via conduit means 134 at a temperature of about 600° F. to 700° F. A portion of said slurry oil can be passed via conduit means 134 to a waste heat steam generator 136 wherein said portion of slurry oil is cooled to a temperature of about 450° F. From the waste heat steam generator 136, the cooled slurry oil flows via conduit 138 as an additional reflux to the lower portion of the main fractional distillation column 98. A second portion of the thus produced slurry oil withdrawn via conduit 140 flows via conduit 140 as product slurry oil.

It will be apparent to those persons skilled in the art that the apparatus and process of the present invention is applicable in any conformation of combination fluidized catalytic cracking-regeneration processes employing first and second (respectively lower and higher temperature) catalyst regeneration zones. For example, in addition to the "stacked" regeneration zones described in the embodiment of FIG. 1, a "side-by-side" catalyst regeneration zone configuration which is described, for example, in U.S. Pat. Nos. 4,601,814; 4,336,160 and 4,332,674 may be employed herein.

Figure 2:
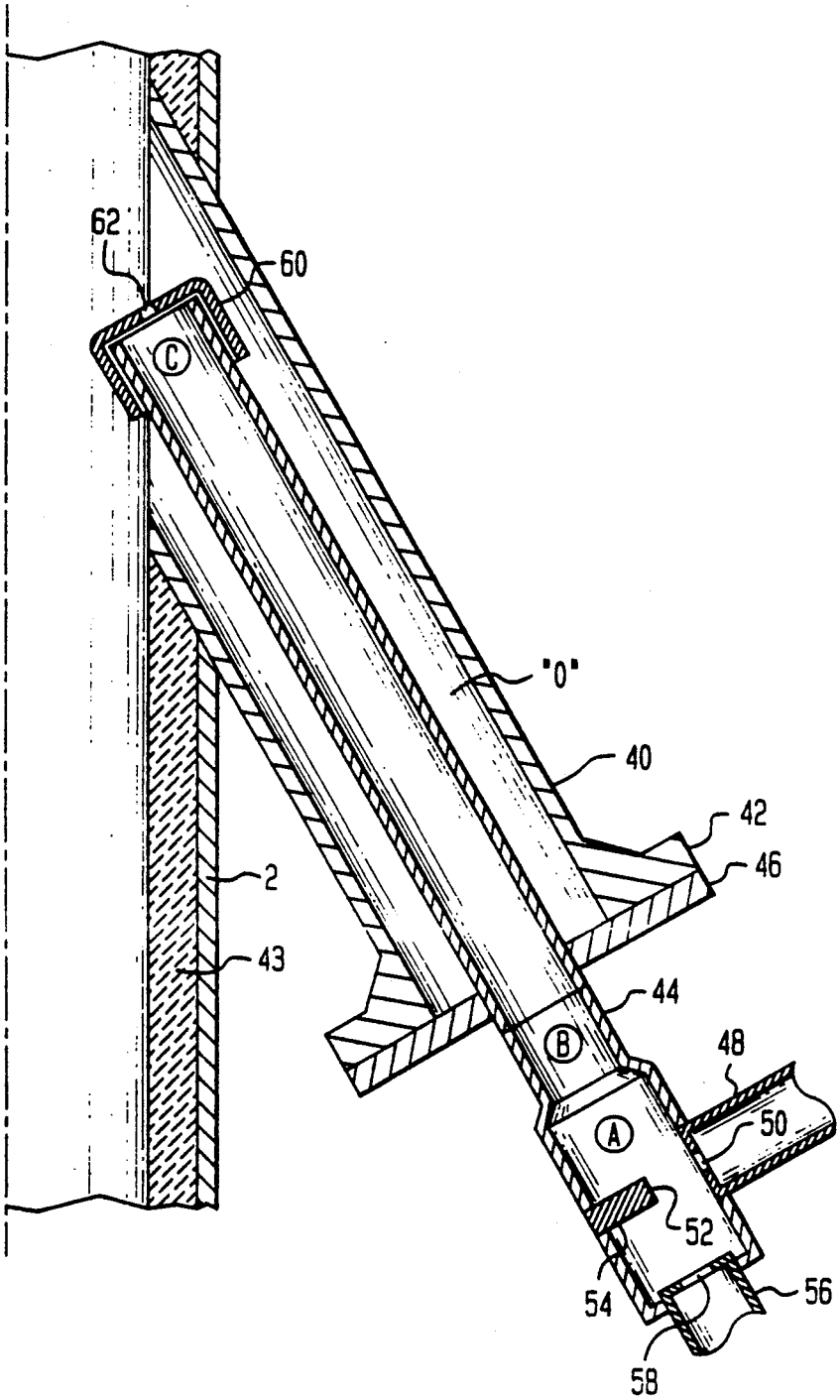
FIG. 2 is a diagrammatic cross-sectional elevational view of one embodiment of an atomizing spray injection nozzle suitable for use in the process and apparatus of the present invention for introducing fresh hydrocarbon feed and recycled light hydrocarbon quench streams into the riser reactor.

Referring to FIG. 2, there is shown in detail one embodiment of an atomizing spray injection nozzle suitable for use in the process and apparatus of the present invention as generally shown in FIG. 1 as 6, 16 and 22 on riser 2 for the introduction of fresh hydrocarbon feed and a light liquid hydrocarbon quench stream into the riser cross-section.

The injection nozzle for atomizing spray injection is preferably positioned with a tubular sleeve means 40 which is attached to and penetrates the wall of riser 2 lined with insulating material 43. The tubular sleeve 40 is of larger diameter than the oil feed nozzle 44 and comprises a flange surface 42 to which the nozzle is attached by a matching flange 46 fastened together by bolts, a ring clamp or other suitable means (not shown). The concentric nozzle arrangement of FIG. 2 positioned with the sleeve comprises a feed atomizing section "A" located external to the sleeve flange and a barrel extension "B" therefrom of sufficient length to position the open end "C" of the barrel provided with cap 60 and opening 62 on a plane adjacent to the inner vertical surface plane of the riser insulating refractory material so as to minimize abrasion of the nozzle tip with fluid catalyst particles and catalyst attrition coming in direct contact with the nozzle tip.

In the specific arrangement of FIG. 2, the nozzle axis is preferably positioned about 30 degrees from the vertical and sloping upwardly with respect to a generally vertical axis or wall of the riser reactor. In this specific embodiment, a hollow pipe sleeve 40 with a flange means 42 and otherwise open at each end thereof slopes generally upwardly and penetrates the riser reactor wall and refractory lining therein at an angle of about 30 degrees. A plurality of such sleeves comprising 2 or more thereof are positioned in a horizontal plane with respect to one another about the riser reactor wall. For example, there may be 2, 3, 4, or more of such sleeves arranged on a horizontal plane with respect to one another and spaced equally from one another about the wall of the riser reactor. The liquid oil atomizing nozzle 44 of this invention is shown coaxially positioned within a sleeve means 40 and rigidly fastened thereto through a flange member 46 as by the use of bolts, collar means or other means (not shown) attaching flange members 42 and 46 in matching relationship with one another. A suitable sealing gasket or annular member discussed below which will resist temperatures up to about 800° F. may be used between flange members as herein provided and desired.

The nozzle system or apparatus of this invention comprises a first atomizing and mixing section "A" external to the flange 42 of the sleeve member, a barrel member "B" which coaxially passes through said sleeve to provide an annular space "D" between said sleeve and said barrel section. A gaseous material such as steam may be added as flushing gas to the annular space to dissipate heat or displace catalyst particles falling therein. An atomized oil charge obtained as herein provided is passed by the elongated barrel "B" to a size restricted discharge opening 62 of a size and shape selected to provide a desired spray pattern as well as discharge velocity of atomized oil as herein provided. The nozzle assembly is positioned so that the axis of opening 62 intercepts a vertical plane aligned with the inner surface of the refractory lining of the riser. On the other hand, the length of the barrel may be adjusted so that opening or orifice 62 lies just inside or slightly outside the refractory lining inner vertical surface plane as required to achieve a given and preselected pattern of spray of the atomized charge within the riser without encountering excessive or unacceptable abrasion of the nozzle tip or deposition of oil spray on the riser wall.

In a preferred utilization of the specific arrangement of FIG. 2, an emulsion of water and heavy residual oil feed preheated to a suitable temperature is introduced to the nozzle 44 by conduit 48 and thence is passed through an orifice opening 50 for achieving a size selected stream thereof for impingement thereof upon a cylindrical flat surface area 52 of a cylindrical member 54 extending from the wall of the mixing section "A" and opposite orifice opening 50. The diameter of the cylindrical member or rod 54 is greater in one embodiment than the diameter of orifice opening 50 so that a stream of the introduced heavy oil emulsion emitted from opening 50 will impact upon surface 52 under reduced oil surface tension conditions and be broken into relatively small droplets of oil which become dispersed within chamber "A". To further atomize the heavy oil droplets thus formed, expanded gaseous material such as steam or other suitable gaseous material is charged to chamber "A" by conduit 56 and orifice opening 58 at a right angle to the oil inlet and a velocity particularly effecting shearing contact between the oil droplet formed by impaction to form even finer droplets resembling a mist of less than 500 micron droplet size thereafter passed through the nozzle barrel "B" to end "C" and opening 62 at the tip of the nozzle. The oil droplets are further sheared and kept in highly atomized suspension by passing through restricted opening 62 adjacent to tip "C". The introduced shearing gas or steamed is charged to the apparatus of FIG. 2, 90 degrees to the oil charge in this particular embodiment, and is of velocity sufficient to provide a nozzle exit velocity at size restricted opening 62 of high velocity up to about 400 ft./sec. and as high as sonic velocities. Nozzle tip opening 62 may be round or slotted as mentioned above and sized to provide a contact spray pattern of droplets within the range of 15 to 120 degrees. However, the angle between oil conduit inlet 48 and gaseous conduit inlet 56 may be less than 90 degrees to one another, but preferably at least 30 degrees.

In nozzle arrangements above discussed it is contemplated employing a nozzle barrel "B" length which substantially restricts the extent to which, if any, the tip of the nozzle comprising cap 60 and opening 62 extends inside the wall of the riser. In a specific embodiment, opening 62 is provided within cap 60 which screws on the end of barrel "B" or is fastened thereto by any other suitable arrangement which permits changing the cap and/or barrel to change the diameter of opening 62 as required for altering the spread of the atomized droplet spray pattern emitted therefrom at a selected velocity. It is also preferred to control the spray pattern and atomized oil discharge so that the atomized oil does not penetrate upflowing fluid particles of catalyst sufficient to contact and coke the opposite wall of the riser.

In the specific arrangement of the drawing, cylindrical member 52 may be a large diameter bolt which screws through or is otherwise attached to the wall of mixing chamber "A" for adjusting the distance between surface 52 and opening 50 to achieve desired droplet formation. On the other hand, it may be a solid rod or a "T" shaped circular member permanently fixed or adjustable which permits more unrestricted passage of atomizing gaseous material of desired velocity in shearing contact with oil droplets dispersed by the top surface of the solid rod or the "T" shaped rod. Thus the arrangement of apparatus comprising the nozzle and the rates of flow of heavy oil and atomizing gas charged thereto may be varied over a relatively wide range depending on feed viscosity and surface tension modified with water emulsified therewith to achieve desired atomization thereof to droplets of a size less than 500 microns and preferably less than about 100 microns thereby forming a desired fog or mist of droplets for dispersion contact with fluidized particles of catalyst in the riser reactor at a desired elevated hydrocarbon conversion temperature. It will be recognized by those skilled in the art that gasiform materials other than steam may be employed to further atomize the oil droplets of emulsion. Thus, any of the known diluent material materials of the prior art may be employed, such as dry gaseous products of hydrocarbon conversion, $CO_2$ water, steam, light olefins and combinations thereof.

We claim:

1. In a fluidized catalytic cracking-regeneration process for cracking hydrocarbon feedstocks or the vapors thereof with a cracking catalyst in a riser conversion zone having a mix zone, a primary cracking zone and a secondary cracking zone to produce hydrocarbon conversion productions comprising a heavy naphtha fraction and materials lower boiling than said heavy naphtha fraction, a heavy cycle oil fraction and materials higher boiling than said heavy cycle oil fraction, then separating catalyst particles comprising hydrocarbonaceous deposits thereon from said hydrocarbon conversion products, and regenerating the separated catalyst particles in at least one catalyst regeneration zone in the presence of a source of oxygen, and recycling the regenerated catalyst back to the riser conversion zone, wherein the improvement comprises the steps of:

(a) charging a hydrocarbon feedstock into said riser conversion zone wherein said hydrocarbon feedstock is admixed with freshly regenerated cracking catalyst as a suspension at an elevated temperature and under conditions to maintain a mix zone temperature within the range of about 960° F. to about 1160° F. for about 0.25 seconds or less to completely vaporize the hydrocarbon feed and passing the suspension upwardly through a lower portion of the riser conversion zone;

(b) charging a recycled portion of a light liquid hydrocarbon stream of heavy naphtha fraction having a boiling point of mainly from about 330° F. to about 430° F. produced from hydrocarbon conversation into said upwardly flowing suspension at the outlet of the mix zone prior to passage into the primary catalytic zone to reduce the temperature of the mix zone from about 20° F. to about 100° F. and below the temperature in the mix zone under conditions to maintain a riser conversion zone outlet temperature within the range of about 870° F. to about 950° F.; and (c) recovering an improved yield of light cycle oil/distillate product over that obtainable in the absence of charging the light liquid hydrocarbon stream.

2. The process of claim 1 wherein said regenerating comprises combusting hydrocarbonaceous deposits on the catalyst in separate first and second catalyst regeneration zones, successively, in the presence of an oxygen-containing gas under conditions effective to produce a first regeneration zone flue gas rich in carbon monoxide and a second regeneration zone flue gas rich in carbon dioxide, wherein temperatures in the first regeneration zone range up to about 1500° F., and temperatures in the second regeneration zone range up to about 1800° F.

3. The process of claim 2 wherein temperatures in the first regeneration zone range from about 1100° F. to about 1260° F., and temperatures in the second regeneration zone range from about 1300° F. to about 1600° F.

4. The process of claim 1, wherein the hydrocarbon feedstock comprises gas oils.

5. The process of claim 4 wherein the hydrocarbon feedstock is charged into the riser conversion zone through injection of a plurality of horizontally spaced apart feed injection nozzles thereby producing globules of hydrocarbon feed having an average size of 500 microns or less in diameter.

6. The process of claim 5 wherein globules of hydrocarbon feed having an average size of 100 microns or less in diameter are produced.

7. The process of claim 1, further comprising the step wherein a second recycled portion of the heavy naphtha fraction is charged to the riser conversion zone between the primary and the secondary catalytic zones at from about 0.75 seconds to about 1.25 seconds after injection of the feedstock.

8. The process of claim 1, step (a), wherein substantially no liquid hydrocarbons remain in the mix zone after about 0.25 seconds or less.

9. The process of claim 1, step (b), wherein the riser conversion outlet temperature is maintained at a temperature of 880° F. to 910° F.

10. In a fluidized catalytic cracking-regeneration process for cracking hydrocarbon feedstocks or the vapors thereof with a cracking catalyst in a riser conversion zone having a mix zone, a primary catalytic zone and a second catalytic zone to produce hydrocarbon conversation products comprising a heavy naphtha fraction and materials lower boiling than said heavy naphtha fraction, a heavy cycle oil fraction and materials higher boiling than said heavy cycle oil, then separating catalyst particles comprising hydrocarbonaceous deposits thereon from said hydrocarbon conversion products, and regenerating the separated catalyst particles in at least one catalyst regenerating zone in the presence of a source of oxygen, and recycling the regenerated catalyst back to the riser conversion zone, wherein the improvement comprises the steps of:

(a) charging a hydrocarbon feedstock into said riser conversion zone wherein said hydrocarbon feedstock is admixed with freshly regenerated cracking catalyst as a suspension at an elevated temperature and under conditions to maintain a mix zone temperature within the range of about 960° F. to about 1160° F. for about 0.25 seconds or less and passing the suspension upwardly through a lower portion of the riser conversation zone;

(b) charging a recycled portion of a light liquid hydrocarbon stream of heavy naphtha fraction having a boiling point of mainly from about 330° F. to about 430° F. produced from hydrocarbon conversion into said upwardly flowing suspension at the outlet of the mix zone prior to passage into the primary catalytic zone to reduce the temperature at the mix zone outlet from about 20° F. to about 100° F. below the temperature in the mix zone under conditions sufficient to maintain a riser conversion zone outlet temperature within the range of about 870° F. to about 1020° F.;

(c) passing the suspension into a primary catalytic zone wherein the temperature ranges from about 870° F. to about 1100° F.

(d) charging a recycled portion of a light liquid hydrocarbon stream of heavy naphtha fraction produced from hydrocarbon conversion into said upwardly flowing suspension at a residence time from about 0.75 seconds to about 1.25 seconds after charging the hydrocarbon feedstock to reduce the temperature at the primary catalyst zone outlet to a temperature which ranges from about 980° F. to about 1020° F. prior to passage into the secondary catalyst zone; and (e) recovering an improved yield of light olefin product over that obtainable in the absence of charging the recycled light liquid hydrocarbon streams.

11. The process of claim 10 wherein said regeneration of separated catalyst particles comprises combusting hydrocarbonaceous deposits on the catalyst in separate first and second catalyst regeneration zones, successively, in the presence of an oxygen-containing gas under conditions effective to produce a first regeneration zone flue gas rich in carbon monoxide and a second regeneration zone flue gas rich in carbon dioxide, wherein temperatures in the first regeneration zone range from about 1300° F. to about 1500° F., and temperatures in the second regeneration zone range from about 1300° F. to about 1800° F.

12. The process of claim 11 wherein temperatures in the first regeneration zone from about 1100° F. to about 1260° F., and temperatures in the second regeneration zone range from about 1330° F. to about 1600° F.

13. The process of claim 10 wherein the hydrocarbon feedstocks comprise gas oils.

* * * * *

UNITED STATES PATENT AND TRADEMARK OFFICE

CERTIFICATE OF CORRECTION

PATENT NO. : 5,087,349

DATED : February 11, 1992

INVENTOR(S) : Alan R. Goelzer and Francis A. Demers

It is certified that error appears in the above-identified patent and that said Letters Patent is hereby corrected as shown below:

In Claim 1, column 18, lines 51-52, "conversation" should read --conversion--.

In Claim 1, column 18, line 56, delete "and".

In Claim 5, column 19, line 15, delete "of" first occurrence and insert --by-- therefor.

In Claim 10, column 19, line 39, "conversation" should read --conversion--.

Signed and Sealed this

Twenty-first Day of September, 1993

Bruce Lehman

*Attest:*

BRUCE LEHMAN

*Attesting Officer*

*Commissioner of Patents and Trademarks*